US006729861B2

(12) United States Patent
Oh et al.

(10) Patent No.: US 6,729,861 B2
(45) Date of Patent: May 4, 2004

(54) RECIPROCATING COMPRESSOR WITH SUPPORT SPRINGS PLACED BETWEEN SUPPORT MEMBERS FOR RADIAL COMPACTNESS

(75) Inventors: Won-Sik Oh, Seoul (KR); Hyuk Lee, Siheung (KR); Hyung-Jin Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 7 days.

(21) Appl. No.: 10/188,076

(22) Filed: Jul. 3, 2002

(65) Prior Publication Data

US 2003/0099559 A1 May 29, 2003

(30) Foreign Application Priority Data

Nov. 23, 2001 (KR) ..... 2001-73497

(51) Int. Cl.[7] ..... F04B 17/03
(52) U.S. Cl. ..... 417/417; 417/363; 417/902
(58) Field of Search ..... 417/417, 363, 417/902

(56) References Cited

U.S. PATENT DOCUMENTS 5,772,410 A * 6/1998 Chang ..... 417/363
6,435,842 B2 * 8/2002 Song ..... 417/363
2002/0057974 A1 * 5/2002 Toyama et al. ..... 417/417
2002/0164255 A1 * 11/2002 Burr et al. ..... 417/363
2003/0095879 A1 * 5/2003 Oh et al. ..... 417/417
2003/0129069 A1 * 7/2003 Bae et al. ..... 417/363
2003/0133812 A1 * 7/2003 Puff et al. ..... 417/363

* cited by examiner

*Primary Examiner*—Justine R. Yu
*Assistant Examiner*—Emmanuel Sayoc
(74) *Attorney, Agent, or Firm*—Birch, Stewart, Kolasch & Birch, LLP

(57) ABSTRACT

A reciprocating compressor includes a compressing unit fixed by a first frame inside a hermetic casing, for compressing gas, a driving motor fixed by a second frame and a third frame inside the hermetic casing, a spring seat member connected with a piston of the compressing unit and positioned between the first frame and the second frame, a plurality of connection members respectively connecting the first and second frame and having a predetermined space in the circumferential direction of the first and second frame, a first spring installed between the first frame and the spring seat member, a second spring installed between the spring seat member and the second frame, wherein each end of the first and second springs is positioned in a space among the connection members. Therefore, the compressor can be miniaturized and the installation space of the compressor can be substantially reduced.

16 Claims, 7 Drawing Sheets

RECIPROCATING COMPRESSOR WITH SUPPORT SPRINGS PLACED BETWEEN SUPPORT MEMBERS FOR RADIAL COMPACTNESS

BACKGROUND OF THE INVENTION

1. Field of the Invention

The present invention relates to a reciprocating compressor and particularly, to a reciprocating compressor, capable of enabling miniaturization of a compressor as a diameter of a compressor can be reduced and attenuating the installation space of the compressor.

2. Description of the Background Art

Generally, a compressor is an instrument for compressing fluid such as air and refrigerant gas and is classified into many kinds of compressors, such as a rotary compressor, reciprocating compressor, a scroll compressor and the like, according to the structure of the compressing method.

FIG. 1 is a longitudinal sectional view showing a reciprocating compressor in accordance with the conventional art, FIG. 2 is a longitudinal sectional view showing an arrangement structure of a spring of the reciprocating compressor in accordance with the conventional art and FIG. 3 is a cross-sectional view taken along section line III—III of FIG. 2.

The reciprocating compressor in accordance with the conventional art includes a hermetic casing 10 which is connected with a suction tube 12 to which gas is sucked and discharging tube 14, a driving motor 30 which is positioned inside the hermetic casing 10, for generating a reciprocating driving force, a compressing unit 40 for compressing gas moving reciprocatingly by receiving the driving force of the driving motor 30 and a plurality of frames which are fixed inside the hermetic casing, for supporting the driving motor 30 and compressing unit 40.

The driving motor 30 includes a cylindrical outer core 31, an inner core 32 which is positioned at a predetermined interval with the inner circumferential surface of the outer core 31, a winding coil 35 which is wound inside the outer core 31 and to which a power source is supplied from the outside, a magnet 33 which is positioned between the outer core 31 and inner core 32 at a predetermined interval and performs a linear reciprocating movement when the power source is supplied to the winding coil 35.

The compressing unit 40 includes a piston 42 which is connected with the magnet 33 by a magnet holder 34, a cylinder 41 in which the piston 42 is inserted slidably, for forming a predetermined compression space, and a valve assembly 44 positioned at the front of the cylinder 41, for performing opening and closing operations for the discharged gas.

Here, a first frame 21 is fixed on the outer circumferential surface of the cylinder 41 and the second and third frames 22 and 23 are supported on the both surfaces of the outer core 31.

The first frame 21 and second frame 22 are connected to each other by a connection member 24 and the second and third frames 22 and 23 are connected to each other by a bolt 61. The piston 42 is connected to the portion between the first and second frames 21 and 22, and a spring seat member 53 which performs a reciprocating movement together is positioned therein. A first spring 51 for giving an elastic force in the direction that the piston 42 moves backwards is positioned between a side surface of the first frame 21 and a side surface of the spring seat member 53, and a second spring 52 for giving an elastic force in the direction that the piston 42 moves forwards is positioned between the spring seat member 53 and second frame 22.

Here, the first spring 51 is mounted between an inner surface of a portion which is connected with the connection member 24 of the first frame 21 and a side surface of the spring seat member 53, stores an elastic force when the piston 42 moves forwards and gives the force when the piston 42 moves backwards. The second spring 52 is mounted between an another surface of a spring seat member 53 and a side surface of the second frame 22, stores an elastic force when the piston 42 moves forwards and gives the force when the piston 42 moves backwards.

Such reciprocating compressor has been gradually miniaturized and accordingly technology for miniaturizing the compressor maintaining an identical operation performance is required.

Therefore, the technology for miniaturizing the diameters of the first, second and third frames has become more influential, since the diameter of the hermetic casing is determined by the diameters of the first, second and third frames.

However, since the first and second springs are mounted on the inner surface of a part which is connected with the connection member of the first frame, diameter of each frame must be maintained larger than a predetermined level. Therefore, it is impossible to reduce the diameter, and accordingly the diameter of the compressor is larger than a predetermined level, thus to require larger installation space where the compressor is positioned and increase manufacturing cost of the compressor.

SUMMARY OF THE INVENTION

Therefore, an object of the present invention is to provide a reciprocating compressor, capable of reducing a diameter of a compressor by reducing diameters of frames, thus to miniaturize the compressor and substantially reduce the installation space of the compressor.

To achieve these and other advantages and in accordance with the purpose of the present invention, as embodied and broadly described herein, there is provided a reciprocating compressor, including a compressing unit fixed by a first frame inside a hermetic casing, for compressing gas, a driving motor fixed by a second frame and a third frame inside the hermetic casing, a spring seat member connected with a piston of the compressing unit and positioned between the first frame and the second frame, a plurality of connection members respectively connecting the first and second frame and having a predetermined space in the circumferential direction of the first and second frame, a first spring installed between the first frame and the spring seat member and a second spring installed between the spring seat member and the second frame, wherein each end of the first and second springs is positioned in a space among the connection members.

Further, there is provided a reciprocating compressor wherein the second and third frames are connected by a plurality of bolts and the bolts are inserted into a plurality of through holes circumferentially formed in a outer core of the driving motor.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
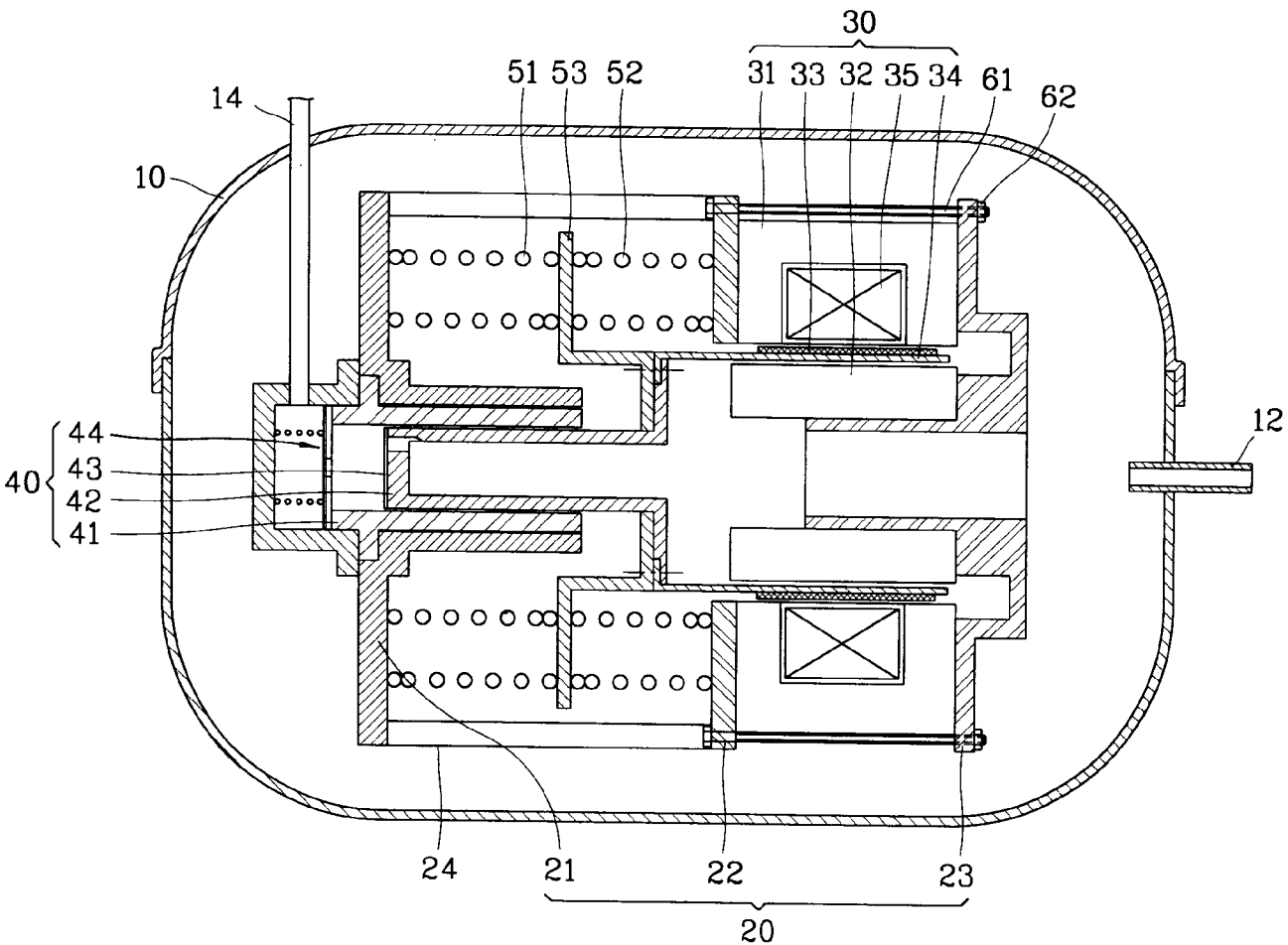
FIG. 1 CONVENTIONAL ART
FIG. 1 is a longitudinal sectional view showing a reciprocating compressor in accordance with the conventional art.
Figure 2:
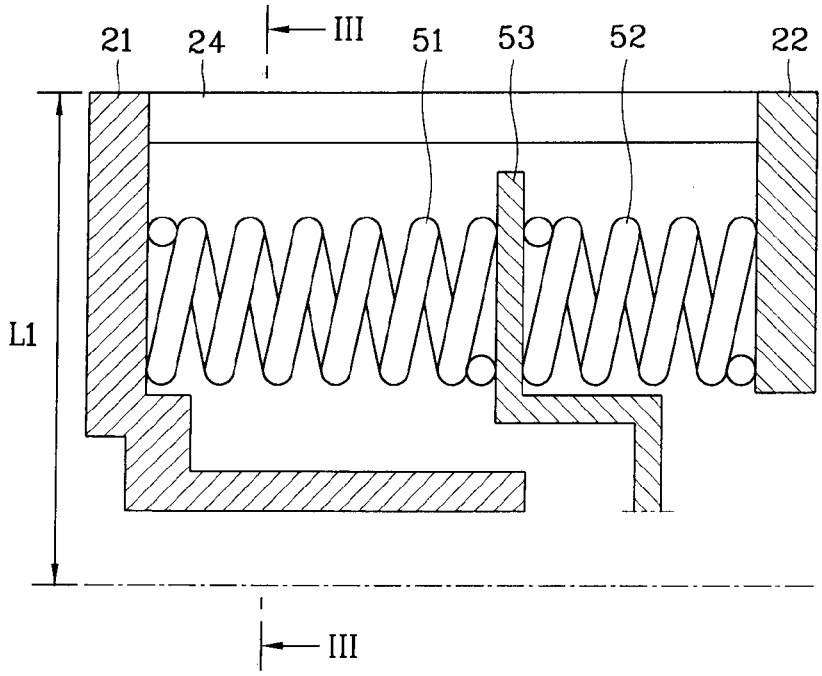
FIG. 2 CONVENTIONAL ART
FIG. 2 is a longitudinal sectional view showing an arrangement structure of a spring of the reciprocating compressor in accordance with the conventional art.
Figure 3:
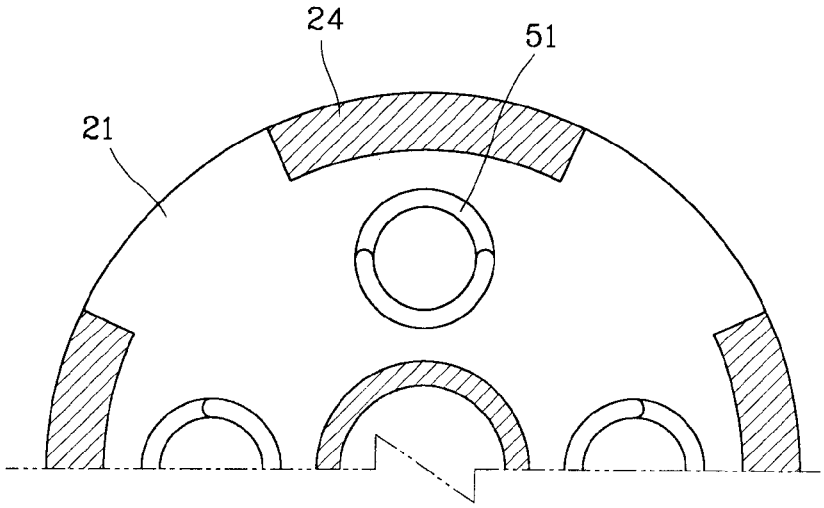
FIG. 3 CONVENTIONAL ART
FIG. 3 is a cross-sectional view taken along section line III—III of FIG. 2.
Figure 4:
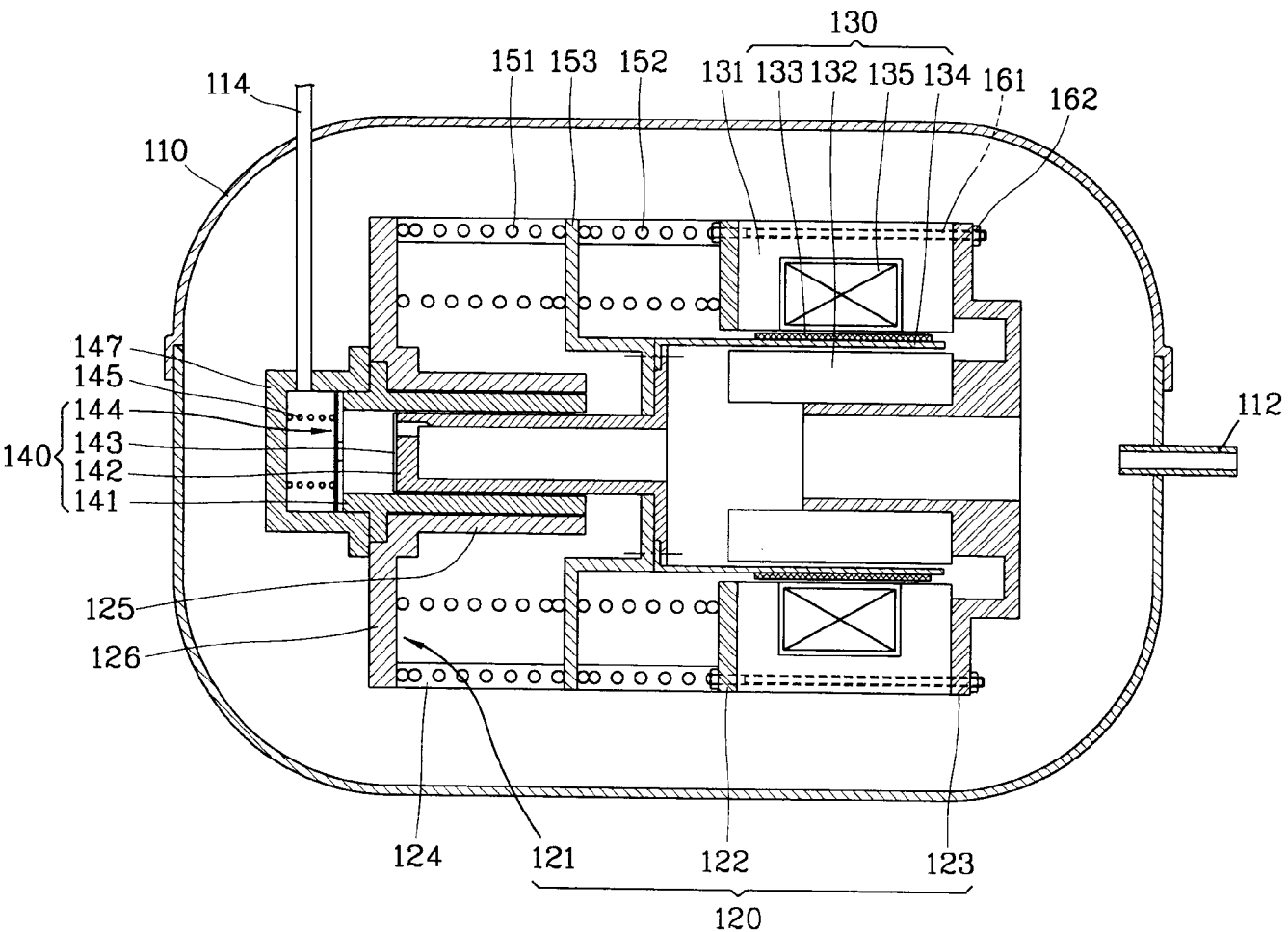
FIG. 4 is a longitudinal sectional view showing a reciprocating compressor in accordance with an embodiment of the present invention.
Figure 5:
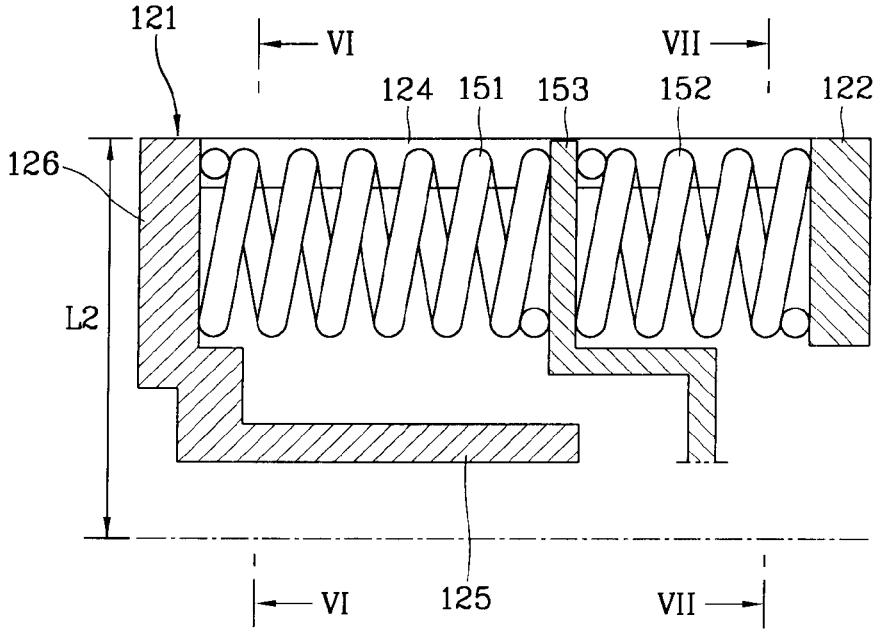
FIG. 5 is a longitudinal sectional view showing an arrangement structure of a spring of the reciprocating compressor in accordance with the embodiment of the present invention.
Figure 6:
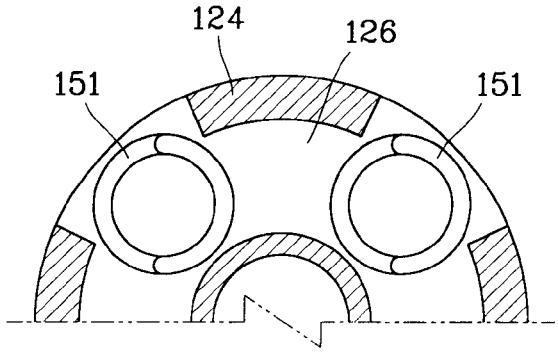
FIG. 6 is a cross-sectional view taken along section line VI—VI of FIG. 5.
Figure 7:
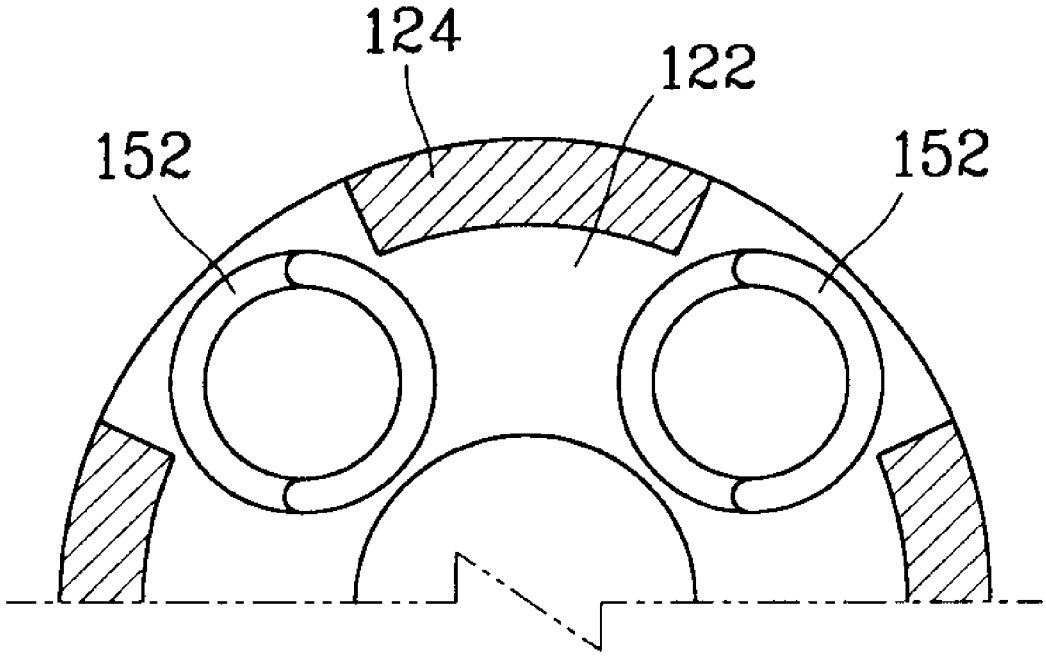
FIG. 7 is a cross-sectional view taken along section line VII—VII of FIG. 5.

FIG. 4 is a longitudinal sectional view showing a reciprocating compressor in accordance with an embodiment of the present invention, FIG. 5 is a longitudinal sectional view showing an arrangement structure of a spring of the reciprocating compressor in accordance with the embodiment of the present invention, FIG. 6 is a cross-sectional view taken along section line VI—VI of FIG. 5, and FIG. 7 is a cross-sectional view taken along section line VII—VII of FIG. 5.

The reciprocating compressor in accordance with an embodiment of the present invention includes a hermetic casing 110 having a hermetic space, a driving motor 130 which is mounted in the hermetic casing 110, for generating a linear reciprocating force, a compressing unit 140 for compressing gas performing a linear reciprocating movement by a driving force of the driving motor 130 and a plurality of frames 120 for supporting the driving motor 130 and compressing unit 140.

The hermetic casing 110 is formed in a cylindrical shape having a predetermined closed inner space and connected with the suction tube 112 to which gas is sucked and a discharge tube 114 through which compressed gas is discharged.

The driving motor 130 includes an outer core 131 which is formed in the cylindrical shape, an inner core 132 which is positioned at a predetermined interval with the inner circumferential surface of the outer core 131, a winding coil 135 which is wound inside the outer core 131 and to which a power source is supplied from the outside, a magnet 33 which is positioned between the outer core 131 and inner core 132 at a predetermined interval and performs a linear reciprocating movement when the power source is supplied to the winding coil 135.

The compressing unit 140 includes a piston 142 connected with the magnet 133 by a magnet holder 134, which performs a linear reciprocating movement, a cylinder 141 in which the piston 142 is inserted slidably, for forming a predetermined compression space, and a valve assembly 144 positioned at the front of the cylinder 141, for performing opening and closing operations for the discharged gas.

The frame 120 includes a first frame 121 to which an outer circumferential surface of the cylinder is fixed, a second frame 122 connected with the first frame 121, for supporting a side surface of the outer core 131, and a third frame 123 connected with the second frame 122, for supporting the other side surface of the outer core 131.

Here, a spring seat member 153 which is connected with the piston 142 and performs a linear reciprocating movement together with the piston 142, is positioned between the first frame 121 and second frame 122, a first spring 151 is positioned between the first frame 121 and the spring seat member 153, and a second spring 152 is positioned between the spring panel 153 and the second frame 122.

The first frame 121 includes a fixing portion 125 which is formed is a cylindrical shape and to which the cylinder 141 is fixed, and a supporting portion 126 lengthened in the shape of a circular plate outwards from a side of the fixing portion 125, to which the first spring is supported and a plurality of connection members 124 are fixed to an edge portion of the inner side surface of the supporting portion 126 at a predetermined interval in the circumferential direction.

Here, the connection members 124 are formed in a plate type having a predetermined curvature and have a predetermined thickness so that they can support between the first frame 121 and second frame 122.

It is desirable that a coil spring is used as the first spring 151 and it is positioned near the edge of the inner surface of the supporting portion 126 of the first frame 121 so that the diameter of the first frame 121 can be minimized.

Namely, spaces among the connection members 124 are formed to have a predetermined size so that the first spring can be inserted therein and the first spring 151 is positioned in the spaces among the connection members 124. The diameter of the first frame 121 can be reduced as long as the length of the position where the first spring 151 is moved and accordingly the diameter of the hermetic casing 110 can be also reduced as long as the reduced diameter of the first frame 121.

The second and third frames 122 and 123 are also formed to have an identical diameter as the first frame 121.

Namely, the connecting bolt 161 for connecting the second frame 122 and third frame 123 is positioned near the outer surface of the outer core 131 of the driving motor 130.

In case the diameter of the second frame 122 and third frame 123 is more reduced than that of in case the connecting bolt 161 is positioned near the outer surface of the outer core 131, A piece of the outer core 131 is deposited radially and a through hole can be formed so that the connecting bolt 161 passes through the center of center of the outer core 131.

The operation of the reciprocating compressor in accordance with the present invention, with the above composition will be described as follows.

When a power source is applied to the driving motor 130, as a current flows in the winding coil 135 composing the driving motor 130, a flux is formed in the outer core 131 and inner core 132 and a magnet holder 134 which is connected with the magnet 133 performs a linear reciprocating movement by an interaction of the flux generated in the inner core 132 and flux generated in the magnet 133. Accordingly, as the magnet holder 134 performs a linear reciprocating movement, the piston 142 performs a linear reciprocating movement inside the cylinder 141.

As the piston 142 performs a linear reciprocating movement, the gas is sucked to the compression space which is formed inside the cylinder 141 through the suction path inside the piston 142, compressed and discharged.

The gas which is discharged as above is discharged to the outside through the discharge cover 145 and the discharge tube 114.

Here, the first and second springs 151 and 152 store, discharge the linear reciprocating movement force of the driving motor 130 as an elastic energy and induce resonance movement of the movable unit 133 and the piston 142. As the first spring 151 and second spring 152 are all arranged being inserted in a predetermined width among the plurality of connection members 124 which are connected with the first and second frames 121 and 122, the compressor can be miniaturized by reducing the diameter L2 of the frame 120 and the installation space of the compressor can be reduced.

Figure 8:
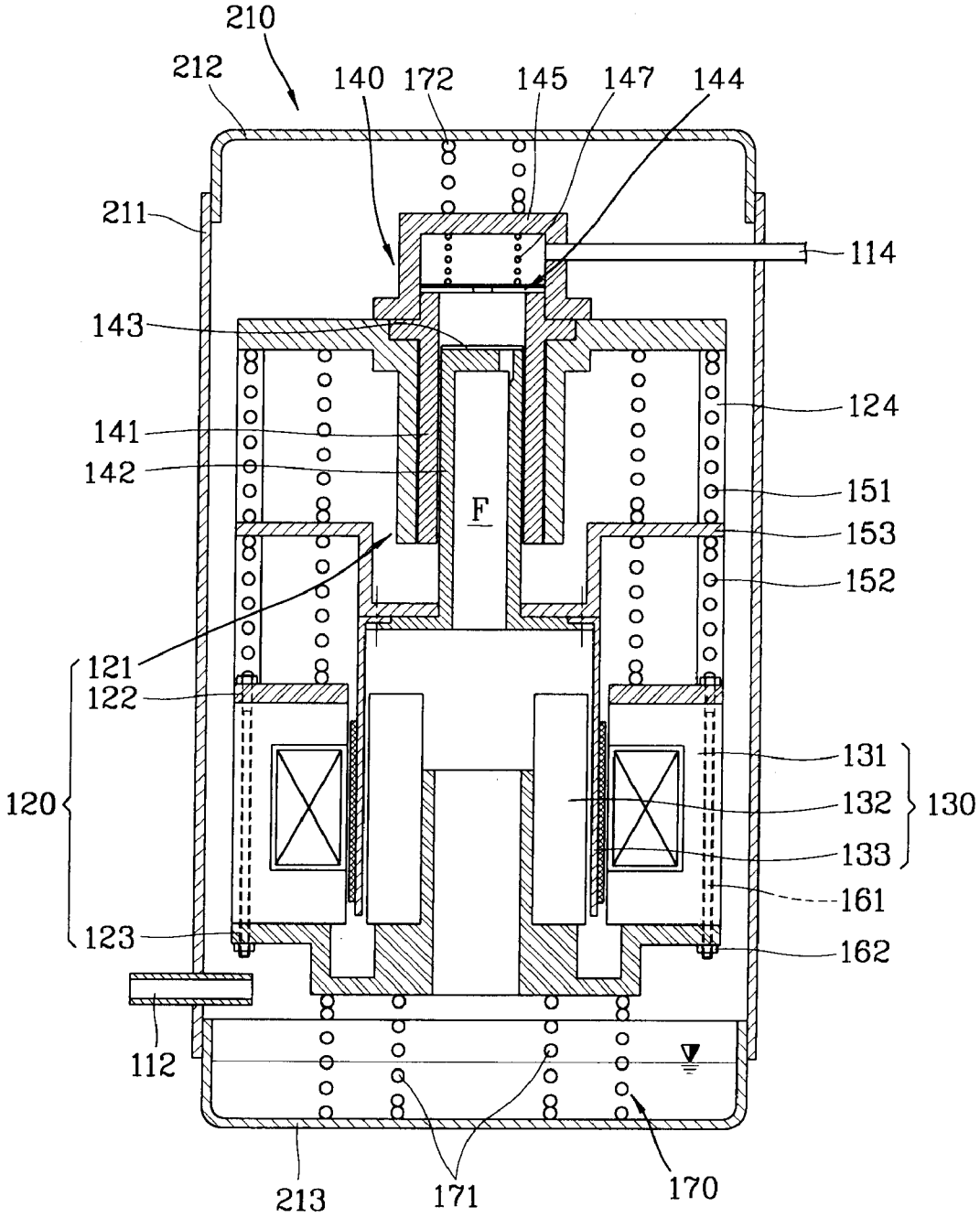
FIG. 8 is a longitudinal sectional view showing the reciprocating compressor in accordance with another embodiment of the present invention.

FIG. 8 is a longitudinal sectional view showing the reciprocating compressor in accordance with another embodiment of the present invention.

In the reciprocating compressor in accordance with another embodiment of the present invention, a compressing unit 140 is positioned vertically inside a hermetic casing 210 which stands vertically, the reciprocating compressor further includes an elastic supporting means 170 fixed on the upper and lower surfaces of the hermetic casing 210, for elastically supporting upper and lower sides of a oscillator which includes the frame 120.

The hermetic casing 210 includes a main body 211 which is lengthened and formed in the upper and lower directions, for accommodating the driving motor 130 and the compressing unit 140, and upper and lower caps 212 and 213 for covering the upper and lower sides of the main body 211.

The elastic supporting means 170, including an upper supporting spring 172 which is fixed to the upper cap 212 of the hermetic casing 210, for supporting an outer surface of the discharge cover 145, and a lower supporting spring 171 which is fixed to the lower cap 213 of the hermetic casing 210, for supporting the outer surface of the third frame 123, elastically supports the upper and lower sides of the oscillator which includes the driving motor 130, compressing unit 140 and frame 120.

Here, the upper and lower supporting springs 172 and 171 are formed as compression coil springs.

Meanwhile, the vertical position of the compressing unit and the driving motor may be replaced respectively.

Namely, the compressing unit is positioned at the lower portion of the hermetic casing, the driving unit is positioned at the upper portion of the hermetic casing.

Therefore, the upper supporting spring is positioned between the upper surface of the third frame and the upper inner wall surface of the hermetic casing and the lower supporting spring is positioned between the lower surface of the compressing unit and the lower inner wall surface of the hermetic casing.

Hereinafter, the description of an identical composition part as in an embodiment of the present invention will be omitted.

In the reciprocating compressor in accordance with the other embodiment of the present invention, the compressing unit 140 is vertically positioned inside the hermetic casing 210 and elastically supported at the upper and lower sides of the hermetic casing 210 under the condition that the first and second springs 151 and 152 are positioned a predetermined width apart among a plurality of connection members 124 to which the first and second frames 121 and 122 are connected, thus to reduce the diameter of the compressor and installation space of the compressor.

Figure 9:
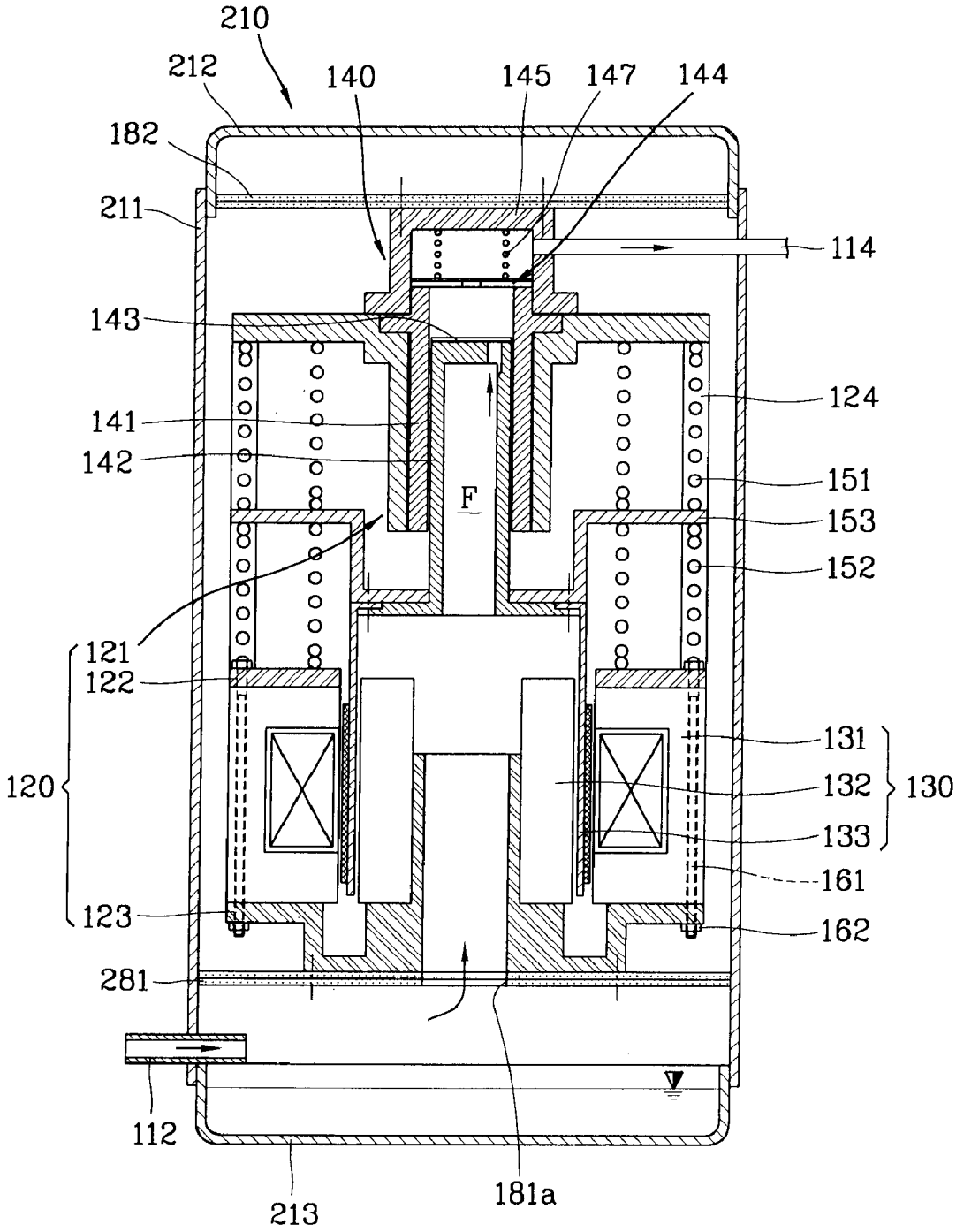
FIG. 9 is a longitudinal sectional view showing the reciprocating compressor in accordance with still another embodiment of the present invention.

FIG. 9 is a longitudinal sectional view showing the reciprocating compressor in accordance with still another embodiment of the present invention.

The elastic supporting means of the reciprocating compressor in accordance with the other embodiment of the present invention includes an upper supporting spring 182 which is formed in a plate type, mounted in the upper cap 212 of the hermetic casing 210 in the horizontal direction and connected with the discharge cover 145, and a lower supporting spring 181 which is formed in a plate type, is mounted at the lower side of the main body 211 of the hermetic casing 210 in the horizontal direction, and supports a rear frame 123.

The upper supporting spring 182 is formed in a plate type in the shape that two circular plates are deposited, to support the vibration which is generated in the compressing unit 140 and driving motor 130 in the upper and lower directions.

The lower supporting spring 181 supports the third frame 123, and at the same time, is formed in a plate type in the shape that two circular plates are deposited to support the vibration generated in the compressing unit 140 and the driving motor 130 in the upper and lower directions, and a through hole 181A is formed at the center of the spring 181 to pass gas.

Hereinafter, description of the component part identical as in an embodiment and the other embodiment of the present invention described above will be omitted.

In the reciprocating compressor in accordance with the other embodiment of the present invention, the compressing unit 140 is positioned inside the hermetic casing 210 vertically and elastically supported at the upper and lower sides of the hermetic casing 210, thus to reduce the left and right widths and installation space of the compressor.

Also, the upper supporting spring 182 and lower supporting spring 181 are formed in the plate type and support the compressing unit 140 and frame 120 in the upper and lower directions and accordingly, vibration of a horizontal direction, which can be generated in moving and driving the compressor can be efficiently attenuated.

As described above, in the reciprocating compressor in accordance with the present invention, as resonating springs, such as the piston is positioned in spaces among the plurality of connection parts by which the frames are connected, the diameter of the frame and hermetic casing, thus to develop a compact compressor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A reciprocating compressor, comprising:

a compressing unit fixed by a first frame inside a hermetic casing, for compressing gas;

a driving motor fixed by a second frame and a third frame inside the hermetic casing;

a spring seat member connected with a piston of the compressing unit and positioned between the first frame and the second frame;

a plurality of axially extending connection members respectively connecting the first and second frame and being spaced from each other in a circumferential radial direction of said compressing unit, to define peripheral spaces therebetween;

a first spring installed between the first frame and the spring seat member; and a second spring installed between the spring seat member and the second frame;

wherein the first and second springs extend radially into said peripheral spaces between said connection members.

2. The compressor of claim 1, wherein the peripheral spaces between the connection members have a predetermined size so that the first spring can be mounted therein.

3. The compressor of claim 1, wherein the first spring and second spring are formed as coil springs.

4. The compressor of claim 1, wherein the second and third frames are connected by a plurality of bolts and the bolts are inserted into a plurality of through holes circumferentially formed in a outer core of the driving motor.

5. The compressor of claim 1, wherein the second and third frames are connected by a plurality of bolts and the bolts are positioned to be abutted to an outer surface of an outer core of the driving motor.

6. A reciprocating compressor, comprising:

a compressing unit vertically disposed in a hermetic casing and fixed by a first frame inside of a hermetic casing, for compressing gas;

a driving motor fixed by a second frame and a third frame inside the hermetic casing;

a spring seat member connected with a piston of the compressing unit and positioned between the first frame and the second frame;

a plurality of axially extending connection members respectively connecting the first and second frame and being spaced from each other in a radially circumferential direction of said compressing unit to define peripheral spaces therebetween;

a first spring installed between the first frame and the spring seat member; and a second spring installed between the spring seat member and the second frame;

wherein the first and second springs extend radially into said peripheral spaces between said connection members.

7. The compressor of claim 6, wherein the peripheral spaces between the connection members have a predetermined size so that the first spring can be mounted.

8. The compressor of claim 6, wherein the first spring and second spring are formed as coil springs.

9. The compressor of claim 6, wherein the second and third frames are connected by a plurality of bolts and the bolts are inserted into a plurality of through holes circumferentially formed in a outer core of the driving motor.

10. The compressor of claim 6, wherein the second frame and third frame are connected by a bolt and the bolt is positioned to be abutted to the outer surface of the outer core of the driving motor.

11. The compressor of claim 6, wherein a first supporting spring is positioned between the upper surface of the compressing unit and the upper inner wall surface of the hermetic casing and a second supporting spring is positioned between the lower surface of the third frame and the lower inner wall surface of the hermetic casing.

12. The compressor of claim 11, wherein the first supporting spring and the second supporting spring are formed as compressing coil springs.

13. The compressor of claim 11, wherein the first supporting spring and the second supporting spring are formed as plate springs.

14. The compressor of claim 6, wherein a first supporting spring is positioned between the lower surface of the compressing unit and the lower inner wall surface of the hermetic casing and a second supporting spring is positioned between the upper surface of the third frame and the upper inner wall surface of the hermetic casing.

15. The compressor of claim 14, wherein the first supporting spring and the second supporting spring are formed as compressing coil springs.

16. The compressor of claim 14, wherein the first supporting spring and the second supporting spring are formed as plate springs.

* * * * *